US006337965B1

(12) United States Patent
Muramatsu

(10) Patent No.: US 6,337,965 B1
(45) Date of Patent: Jan. 8, 2002

(54) COMPACT TONER SUPPLY DEVICE CAPABLE OF PREVENTING INADVERTANT REMOVAL OF TONER BOTTLE AND SCATTERING OF TONER

(75) Inventor: Shigeki Muramatsu, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/666,797

(22) Filed: Sep. 21, 2000

(30) Foreign Application Priority Data

Sep. 22, 1999 (JP) ..... 11-268881

(51) Int. Cl.[7] ..... G03G 15/08
(52) U.S. Cl. ..... 399/258; 399/262
(58) Field of Search ..... 399/258, 262, 399/263, 120; 222/167, 169, 172, DIG. 1; 141/383, 384

(56) References Cited

U.S. PATENT DOCUMENTS 4,089,601 A * 5/1978 Navone ..... 399/13
4,740,808 A * 4/1988 Kasamura et al. ..... 399/12
5,528,349 A * 6/1996 Satake ..... 399/262
5,710,963 A * 1/1998 Dirx ..... 399/262
5,797,073 A * 8/1998 Russell ..... 399/260
5,907,756 A * 5/1999 Shirota et al. ..... 399/262
6,032,013 A * 2/2000 Niizawa ..... 399/262
6,195,521 B1 * 2/2001 Nozawa et al. ..... 399/262
6,256,469 B1 * 7/2001 Taniyama et al. ..... 399/258
6,259,877 B1 * 7/2001 Taniyama et al. ..... 399/262

FOREIGN PATENT DOCUMENTS

JP 06-274028 9/1994

* cited by examiner

*Primary Examiner*—Robert Beatty
(74) *Attorney, Agent, or Firm*—Sughrue Mion, PLLC

(57) ABSTRACT

A toner bottle has a protruding portion on a lateral side of the toner bottle and an incised groove is provided in a bottle holder, and both of them are composed to be removable and to rotate integrally. The incised portion is provided in a position where a toner delivery outlet of the toner bottle is rotated slightly from the state of facing straight up and where the protruding portion of the toner bottle may pass through. That is, according to the relative positioning of the protruding portion of the toner bottle and the incised portion of a ring member, the toner is prevented from spilling out of the toner delivery outlet of the toner bottle by regulating a removable attitude of the toner bottle with respect to the bottle holder.

8 Claims, 7 Drawing Sheets

COMPACT TONER SUPPLY DEVICE CAPABLE OF PREVENTING INADVERTANT REMOVAL OF TONER BOTTLE AND SCATTERING OF TONER

BACKGROUND OF THE INVENTION

The present invention relates to a toner supply device which is for use in a copying machine, a printer, and a facsimile machine utilizing electrophotographic system therein.

A conventional toner supply device has a structure in which a toner bottle is randomly removable regardless of presence of toner in the toner bottle. This causes a problem that toner in the toner bottle is scattered, when a user removes the toner bottle by mistake in spite of toner remaining in the toner bottle.

Accordingly, some toner supply devices have been proposed to solve the above-mentioned problem. For example, one toner supply device has an added function to disable an inadvertent removal of a toner bottle, or another toner supply device has a lid automatically covering a toner delivery outlet of the toner bottle when the toner bottle is removed.

However, such a conventional toner supply device becomes complicated in mechanical structures. Further another conventional toner supply device requires complicated mechanism to be added on a side of the toner bottle, although the toner bottle is consumable. Consequently, none of the conventional toner supply devices is free from problems that running costs get uneconomical.

For example, a toner supply device described in unexamined Japanese Patent Publication No. Hei 6-274028, namely 274028/1994 is equipped with a function to disable an inadvertent removal of a toner bottle as well as a function to close a lid a toner delivery outlet of the toner bottle when the toner bottle is removed. However the toner supply device described in the above-mentioned paper inevitably becomes very complicated in structure.

At first, a mechanism to disable the inadvertent removal of the toner bottle is composed of not only a protrusion provided on an outer surface of a cap of the toner bottle but also a generally L shaped groove provided on an inner surface of the bottle holder secured on a body side of the toner supply device.

However, in this structure, it is required to hold a protrusion of the above-mentioned cap in a draw protective position in the above-mentioned groove while the toner remains. Further, it is also required to shift the protrusion to a draw permissible position in the above-mentioned groove by rotating the above-mentioned cap at the same time.

Consequently, it is required that a rotary drive mechanism of a toner bottle is supplied with a reverse rotation preventing mechanism (worm and wheel) to hold a protrusion of the above-mentioned cap in a draw protective position in the above-mentioned groove but also a backlash mechanism (two pairs of gear equipped with pins of special shape) to develop play positively in the rotary drive mechanism. In addition, there is caused a problem in control that the above-mentioned rotary drive mechanism must reverse its operation whenever a toner bottle is removed. This is because the above-mentioned cap may not be rotated unless the above-mentioned play is transposed into a reversal direction.

Further, the device has a composition in which the cap of the toner bottle is integrally fixed in the bottle holder secured on a body side of the device, although the device has a structure to feed toner utilizing a conveyance function of a helical protrusion caused by rotation of the bottle. As a result, in order to rotate the toner bottle, a structure between a toner bottle and a cap must be rotatable. Accordingly, the toner bottle inevitably becomes complicated in composition.

In addition, the body of the toner bottle cannot be rotated without providing a module (a tooth of a gear) for rotating the body of the toner bottle integrally therewith. Besides, a toner delivery outlet outlet is provided in the cap of the toner bottle at a lateral side of an end surface thereof. A lid, which is automatically closed when the toner bottle is removed, is provided in the portion. However, the lid cannot be reusable, since the lid is mounted on the cap of the toner bottle integrally.

Thus, the toner bottle is composed of at least a body portion having a helical protrusion and a module, a cap rotatably mounted with respect to the body portion, and a reclosable lid mounted on the cap. Therefore, each of these components must be replaced with the new one in the event of running out of toner. Problems are caused to occur in aspects of running costs, and so forth.

SUMMARY OF THE INVENTION

It is therefore an object of the present invention to provide a toner supply device which can solve the defects of the above-mentioned prior art, which has a toner bottle and a body both having a simple structure, and which can surely prevent an inadvertent removal of a toner bottle or scattering of toner.

Other objects of the present invention will become clear as the description proceeds.

The present invention is of a toner supply device providing a cylindrical toner bottle which provides a toner delivery outlet on a lateral of an end portion and a helical protrusion for movement of fine particle toward the toner delivery outlet inside, a bottle holder which holds the toner bottle removably and rotates integrally with the bottle holder, a latch mechanism connecting the bottle holder and the above-mentioned toner bottle, a toner transfer mechanism disposed below the bottle holder to feed toner delivered from the toner bottle to a toner cartridge for development, driving means for rotating or stop driving the bottle holder, and a control portion to control driving means in predetermined timing, consisting of the above-mentioned latch mechanism comprising a protruding portion protruding from a lateral of the toner bottle and an incised groove which is formed in the bottle holder along an inserting direction of the toner bottle engaging to the above-mentioned protruding portion, and having a composition characterized in disposing a ring member to hold the toner bottle rotatably and to prevent the toner bottle from coming off the bottle holder on the toner bottle inserting side of the above-mentioned bottle holder, in providing an incised portion permitting a passage of a protruding portion of the toner bottle in a portion of the ring member, and in placing the incised portion at a position slightly rotated from the position of the above-mentioned incised groove specified in the event that the above-mentioned toner delivery outlet outlet faces upward.

Because of the composition wherein the helical protrusion in the toner bottle exert to feed toner by a rotation of the bottle holder holding the toner bottle, it is not necessary to rotate the toner bottle providing a module in the toner bottle itself, to compose the toner bottle by dividing it into a body portion and a cap, nor to make it rotatable between the body portion and the cap. Therefore, a structure of a toner bottle which is consumable is simplified and reduction of running costs may be possible.

And an inadvertent performance of removing the toner bottle is prevented, as removing the toner bottle out of the bottle holder is limited only when the position of the incised groove formed in the bottle holder meets the position of the incised portion of the ring member.

And in the state that the performance of removing the toner bottle is permitted, that is, the position of the incised groove meets the position of the incised portion, the toner delivery outlet outlet always faces generally upward (a position slightly rotated from a position facing straight up) and a performance of removing the toner bottle is prevented from inadvertent scattering of toner.

Therefore, providing the cap to prevent scattering of toner in the toner bottle is not necessarily required and simplifying the structure of the toner bottle which is consumable is possible.

It is also possible to form the ring member annularly, independently.

And inside of the annular member may be able to hold the toner bottle from outside of it.

Besides, supply of toner may be automatically controlled by equipping the above-mentioned toner cartridge for development with a toner detecting sensor which detects the presence of toner in the toner cartridge for development and by providing a toner supply control function which operates based on a signal which indicates emptiness of toner from the above-mentioned toner detecting sensor and controls the above-mentioned driving means in the above-mentioned control portion.

Accordingly, automatic toner supply is possible by accurate detecting of shortage of toner in the toner cartridge for development.

And when the toner delivery outlet of the bottle holder is disposed facing upward, a toner delivery outlet detecting sensor to detect it is provided on the body side of the device, and a toner delivery outlet positioning control function which operates based on the signal which indicates the presence of toner from the toner detecting sensor and controls driving means so that the above-mentioned toner delivery outlet is disposed facing upward is provided in the above-mentioned control portion.

According to the composition, while toner remains in the toner cartridge for development, a rotated position of the bottle holder is held in the state that the toner delivery outlet faces upward. In such state, there is a deviation between the positions of incised portion in the ring member and incised groove in the bottle holder, and the performance of removing a toner bottle is disturbed and disabled by the protruding portion. That is, in the state that the toner supply device doesn't require any replacement of a toner bottle, a inadvertent performance of removing a toner bottle is disabled.

And input means to command replacement of a toner bottle is provided a toner replacement positioning control function which operates based on toner bottle replacement command from the above-mentioned input means and which controls the above-mentioned driving means so that the bottle holder rotates to reach the position where the above-mentioned toner delivery outlet is slightly rotated from the position facing upward, that is, where the incised portion of the ring member meets the incised groove of the bottle holder is provided in the above-mentioned control portion.

According to the composition, it is possible to bring about a state that a toner bottle is removable by a simple operation on input means. And at this point, only controlling the rotated position with respect to driving means is required and provision of a complicated mechanism with respect to driving means as conventional is not necessary and it results a simplication of structure of the overall toner supply device.

DETAILED DESCRIPTION OF THE PREFERRED EMBODIMENTS

Figure 5:
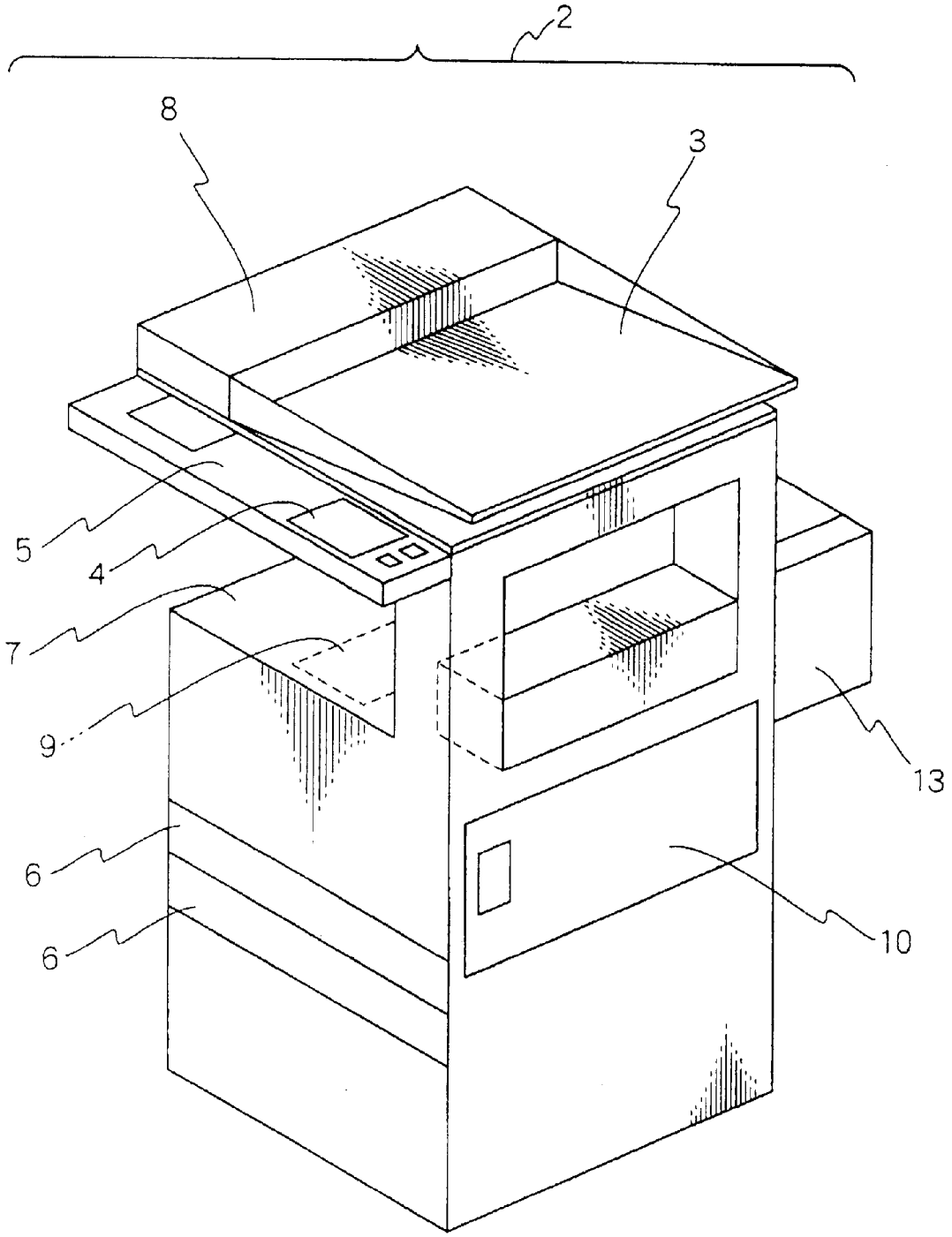
FIG. 5 is a simplified perspective view showing an external view of a copying machine providing the toner supply device of the same embodiment of the present invention therein.

Referring to the drawings, description is made about a toner supply device according to a preferred embodiment of the present invention. FIG. 5 is a simplified perspective view showing an external view of a copying machine 2 having a toner supply device 1 according to the preferred embodiment of the present invention. The copying machine 2 has a structure similar to that of a conventional type except for a portion of the toner supply device. Accordingly, the copying machine 2 is described briefly hereinafter.

At first, the copying machine 2 comprises an original copy set tray 3 for setting original copies which are objects of coping, and operating portion 5 having input means 4 such as a touch panel, and the like, paper cassettes 6 for keeping various sizes of papers, and a paper stacking portion 7 for ejecting and placing copied papers.

Further, an original copy reading portion 8 for reading information from the original copy set in the original copy tray 3, a memory portion 9 for temporarily storing the information which is read at the original copy reading portion 8, a recording portion 10 for printing the information which has been stored in the memory portion 9 on the papers utilizing toner, and a fixer 11 for applying fixation on the paper transcribed with the toner are provided inside of the copying machine 2.

Each of the components is similar to the one in the copying machine of a conventional type to which an electrophotographic system is applied.

Figure 6:
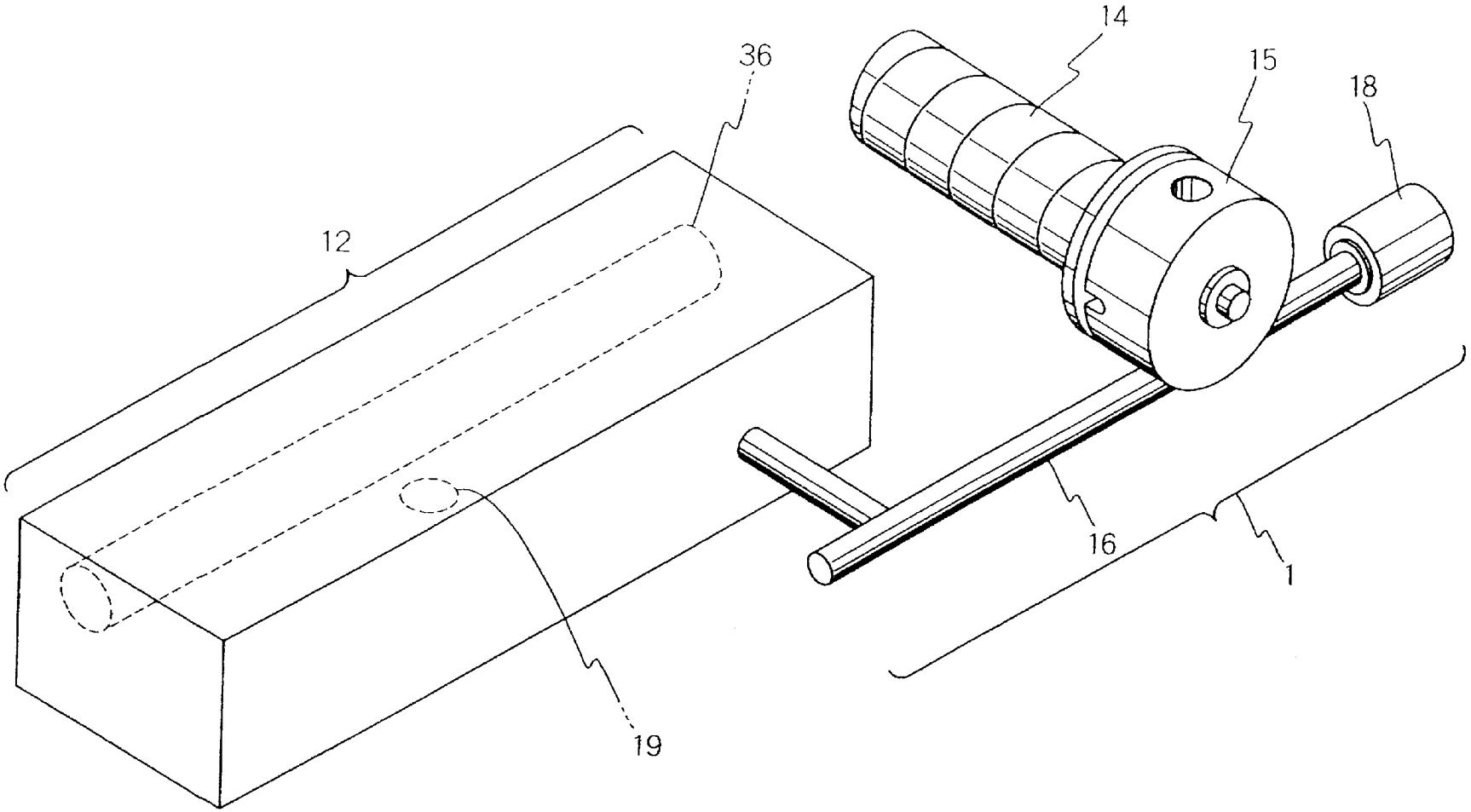
FIG. 6 is simplified conceptual view showing relative positioning of a toner cartridge with respect to the toner supply device.

FIG. 6 is a simplified conceptual view for showing a toner cartridge 12 having a photosensitizor 36 composing a portion of the recording portion 10, a portion of the toner supply device 1 which supplies toner to the toner cartridge 12 in the state of being taken out of the copying machine 2, and the relative positioning of the toner cartridge 12 with respect to the toner supply device 1. Among these components, a portion of toner supply device 1 is contained in a bottle housing portion 13 shown in FIG. 5. As a panel of the bottle housing portion 13 is reclosable, it is possible to replace a toner bottle 14 in which the toner is consumed. Further, in the toner cartridge 12, a toner detecting sensor 19 is provided to detect the presence of toner in the cartridge 12.

As shown in FIG. 6, the toner supply device 1 comprises a toner bottle 14, a bottle holder 15, a toner transfer mechanism 16 for feeding toner supplied from the toner bottle 14 through the bottle holder 15 into the toner cartridge 12.

As shown in FIG. 6, the toner transfer mechanism 16 consists of a pipe shaped member. An opening 17 (as will be described later) for receiving toner supplied from the bottle holder 15 is provided on a periphery of base side thereof. By rotating a screw type feeding mechanism (not shown) inserted in the pipe portion by rotary driving means 18, toner in the pipe can be fed into the toner cartridge 12.

Figure 1:
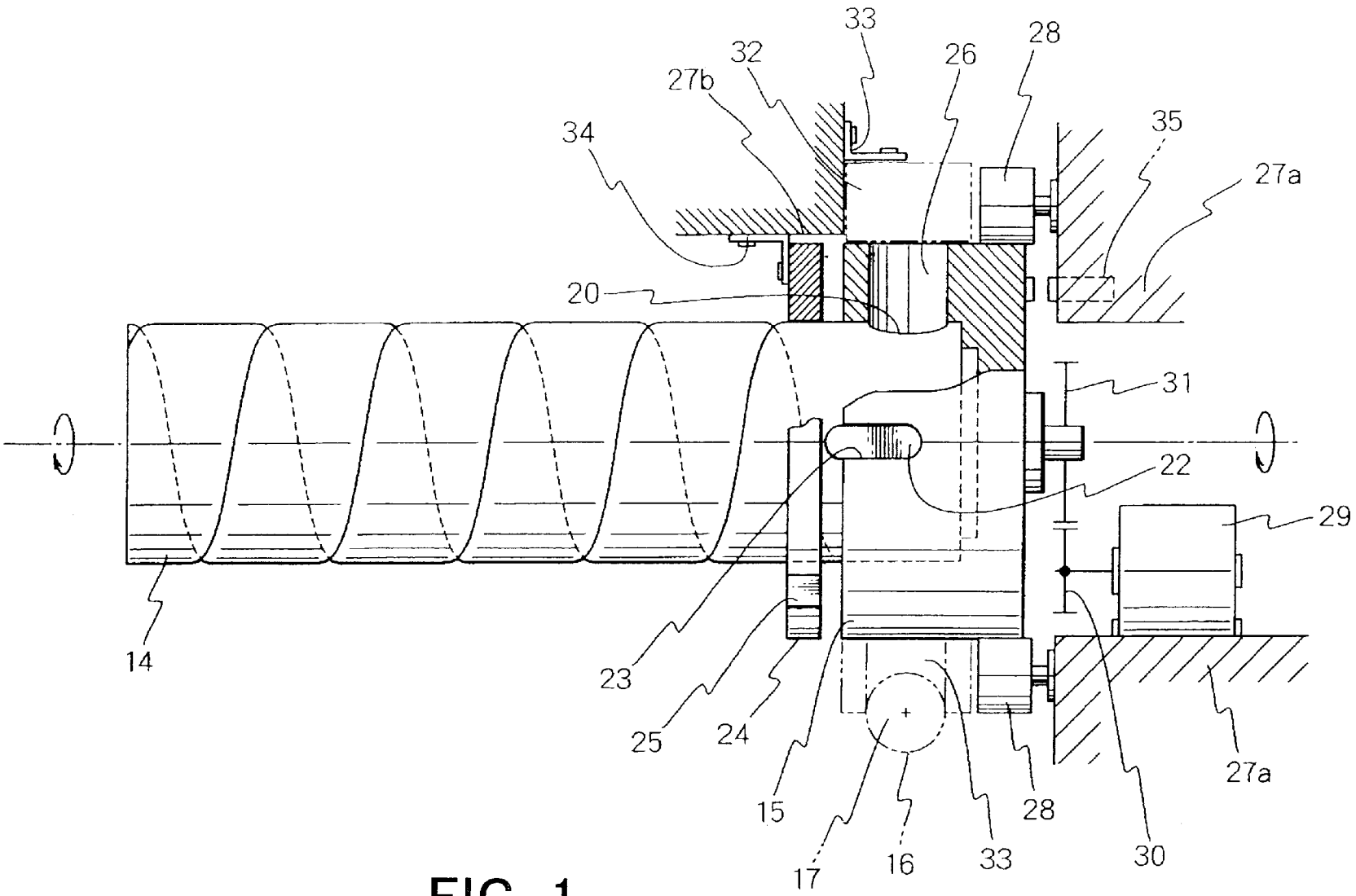
FIG. 1 is a conceptual view showing a composition of the primary portion of a toner supply device.
Figure 2:
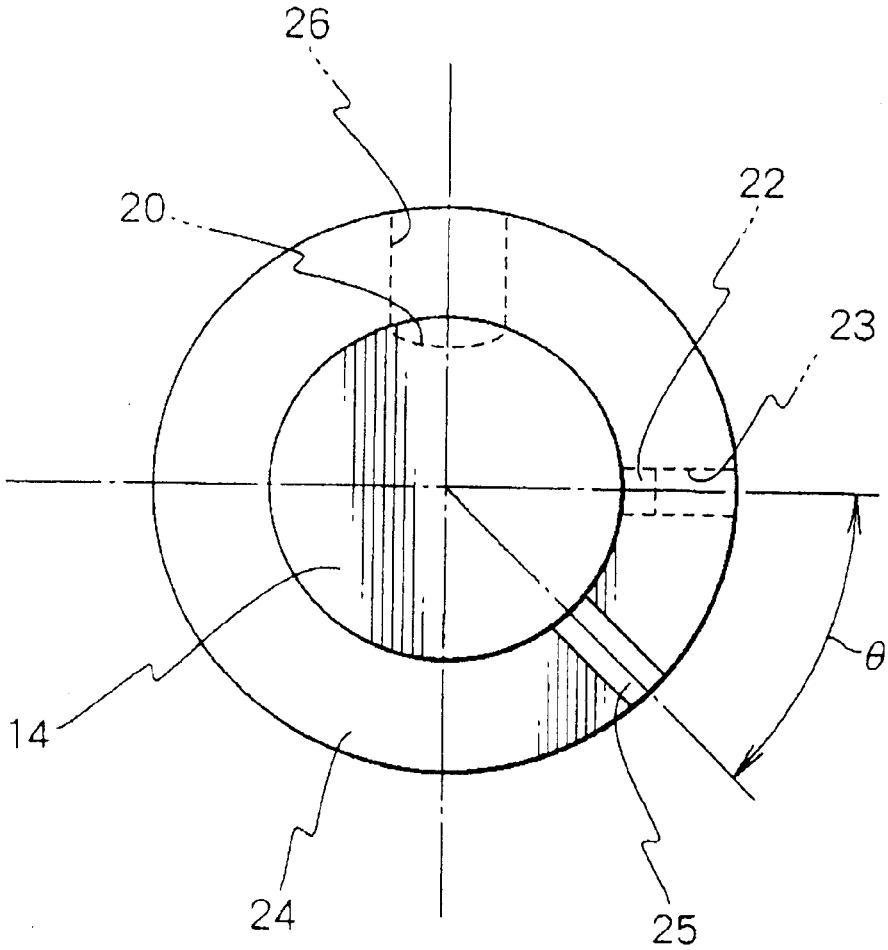
FIG. 2 is a conceptual view showing a relation of mounting position of a ring member for stopper with respect to a bottle holder.
Figure 3:
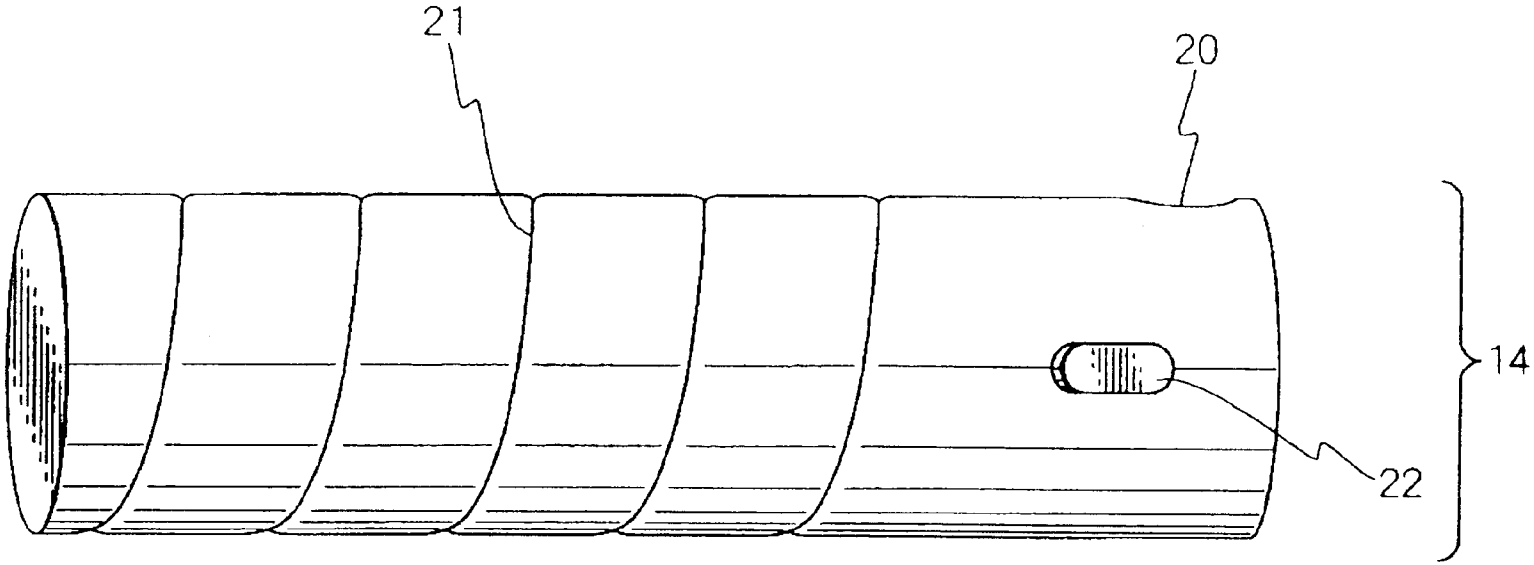
FIG. 3 is a perspective view showing a configuration of a toner bottle.

Compositions of the primary portions of the toner supply device 1 are shown in FIG. 1 through FIG. 4. Initially, the toner bottle 14 is formed integrally with a cylindrical hollow material having both ends closed, as shown in FIG. 3. Further, a toner delivery outlet 20 is on the outer surface of one end portion while a helical protrusion 21 protruding toward the inside is formed all over the length in the axial direction on the inner surface of the toner bottle 14. In addition, a substantially rectangular protruding portion 22 is protruding having both ends thereof rounded with a phase difference (of 90° in this embodiment) with respect to the position of the toner delivery outlet 20.

Figure 4:
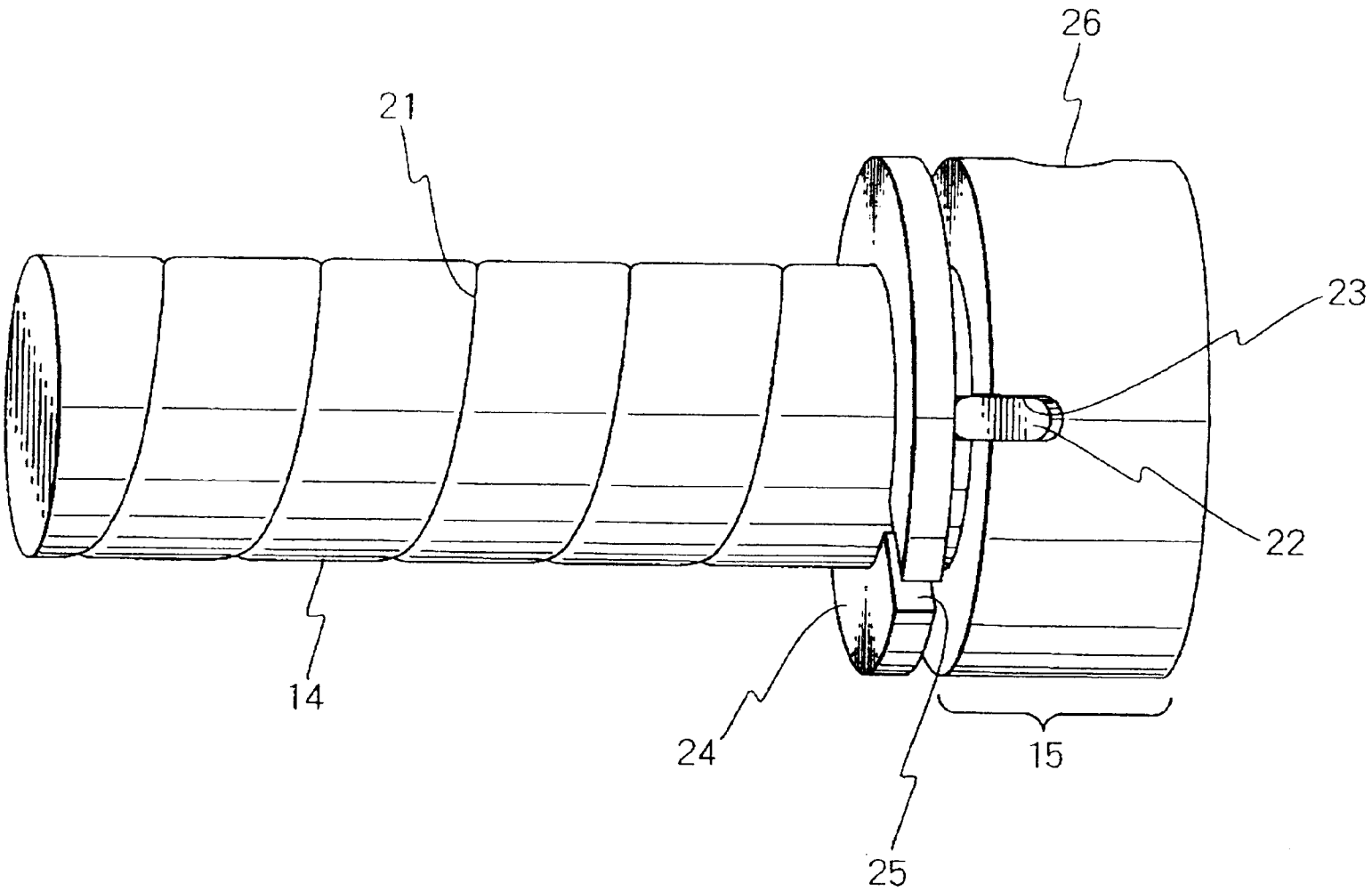
FIG. 4 is a perspective view showing a configuration of the bottle holder having the toner bottle mounted thereon.

FIG. 4 is a perspective view for showing a configuration of the bottle holder 15 in the state of having the toner bottle 14 mounted therein. The bottle holder 15 is a annular member providing an inner diameter which is equal to an outer diameter of the toner bottle 14. An incised groove 23 which is engaged to the protruding portion 22 of the toner bottle 14 is provided on one end of the toner bottle 15 along an inserting direction of the toner bottle 14. In addition, a holder side toner delivery outlet 26 which is provided corresponding to the toner delivery outlet 20 of the toner bottle 14 is provided on the outer surface of the bottle holder 15 penetrating in a radial direction. With the structure, the holder side toner delivery outlet 26 is able to communicate with the toner delivery outlet 20 of the toner bottle 14.

A latch mechanism for connecting the toner bottle 14 and the bottle holder 15 is composed of the protruding portion 22 and the incised groove 23.

Further, a ring member 24 is formed of a generally C-shaped annular material as shown in FIG. 4. An incised portion 25 which permits a passage of the protruding portion 22 of the toner bottle 14 is provided in one portion thereof.

As shown in FIG. 1, the bottle holder 15 is held rotatably by a plurality of rollers 28 which are mounted rotatably on a mount base 27*a* provided inside of the bottle housing portion 13. The bottle holder 15 is adjusted to be driven to rotate through gear 30 and 31 by a motor 29 which composes driving means of the bottle holder 15.

It is preferable to provide the rollers 28 at positions where the rollers 28 contact outer surface of the bottle holder 15, in such manner as 3 pieces with 120° pitch or 4 pieces with 90°.

Further, an annular support block 32 is provided around the bottle holder 15, as if the annular support block 32 surrounds the bottle holder 15. The annular support block 32 it is secured on a mount base 27*b* through a stay 33. The bottle holder 15 is rotatable with respect to the support block 32. A penetrating hole 33 for ejecting toner delivered when the toner delivery outlet 26 of the bottle holder 15 faces downward is retracted in a lower end portion of the support block 32. The opening 17 of the above-mentioned pipe shaped toner transfer mechanism 16 is connected to a lower side of the penetrating hole 33.

As shown in FIG. 1, the ring member 24 is provided leaving a certain amount of space on a side of the bottle holder 15 in which a toner bottle is inserted. The ring member 24 is secured on the mount base 27*b* through the stay 34.

FIG. 2 is a conceptual view for showing the relation of mounting position of the ring member 24 with respect to the bottle holder 15. FIG. 2 simply shows the ring member 24 and the bottle holder 15 of FIG. 1 on a condition that the ring member 24 and the bottle holder 15 are observed from the left side thereof.

As shown in FIG. 2, the incised portion 25 of the ring member 24 is provided in a position slightly rotated (indicated as θ in an example of FIG. 2) from a position where the incised groove 23 is placed when the toner delivery outlet 26 of the bottle 15 faces straight up. Incidentally, the above-mentioned word "slightly" means that the toner bottle 14 has a certain degree of rotation angle preventing toner from spilling out of the toner delivery outlet 20 even though the toner bottle 14 is in the state of being completely filled with toner. As shown in FIG. 1, a toner delivery outlet detecting sensor 35 is buried in the mount base 27*a* on the body side of the device opposing to the bottle holder 15. The toner delivery outlet detecting sensor 35 detects that the delivery 26 is completely turned straight up.

A reflex type optical sensor, a proximity sensor utilizing magnetism, or the like may be utilized as the toner delivery outlet detecting sensor 35.

Figure 7:
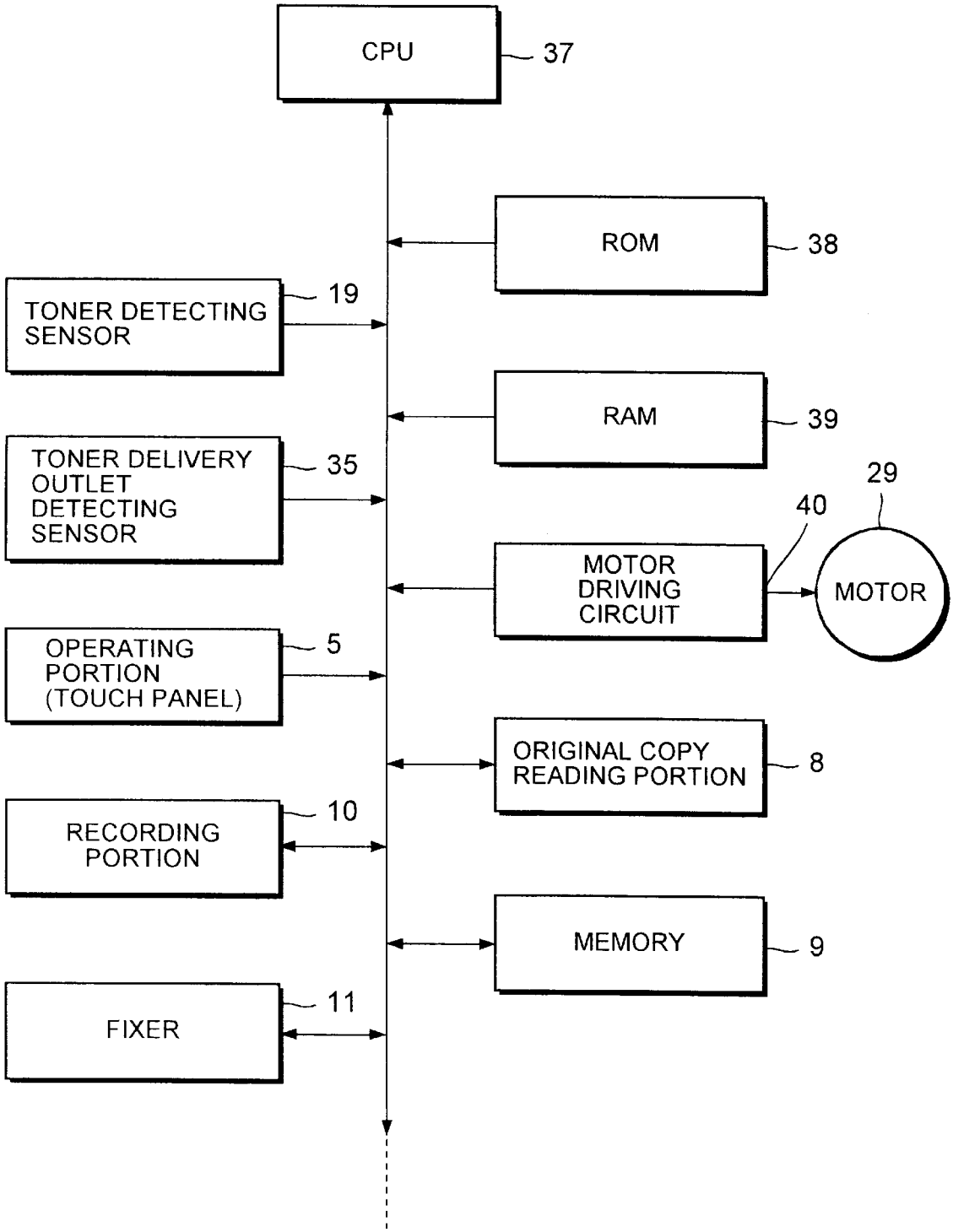
FIG. 7 is a block diagram schematically showing a control portion of the toner supply device.

FIG. 7 is a block diagram for schematically showing a composition of a control portion for controlling the motor 29 which is a drive source of the bottle holder 15. The control portion mainly comprises a CPU 37 as means for executing a program, a RAM 39 to compose temporal memory means for computing, and a ROM 38 as a nonvolatile memory. Among these components, ROM 38 stores various kinds of subprograms which work as function implement means to achieve a toner supply control function, a toner delivery outlet positioning control function, a toner replacement positioning control function, and the like, as well as programs similar to the conventional type ones in relation to control of the original copy reading portion 8, the memory 9, the recording portion 10, and the fixer 11 of the copying machine 2.

At first, 37 implements a usual toner supplying operation automatically by detecting the signal which indicates emptiness of toner from the toner detecting sensor 19.

After detecting the signal which indicates emptiness of toner, the CPU 37 starts the subprogram to achieve the toner supply control function. The CPU 37 controls the motor 29 to be driven by outputting the command to rotate the bottle holder 15 to a motor driving circuit 40. The bottle holder 15 is then rotated. As the bottle holder 15 and the toner bottle 14 are engaged through the incised groove 23 and the protruding portion 22, the toner bottle 14 rotates integrally with the bottle holder 15. During the rotation of the toner bottle 14, the helical protrusion 21 on the inner surface of the toner bottle 14 sends toner in the toner bottle 14 toward the end surface on a side of toner delivery outlet 20.

When the toner delivery outlet 20 of the toner bottle 14 and the toner delivery outlet 26 of the bottle holder 15 face downward, a portion of the toner which is sent to the side of the end surface drops downward through the toner deliveries 20 and 26. The portion of the toner is fed to the opening 17 of the toner transfer mechanism 16.

Toner fed to the toner transfer mechanism 16 is conveyed further to the toner cartridge 12 by the screw type feeding mechanism which is driven by rotary driving means 18. As the result, the toner cartridge 12 is supplied with toner.

Thus, when the toner cartridge 12 is supplied with toner, the output signal from the toner detecting sensor 19 turns the indication thereof from toner emptiness into toner presence. After detecting the signal, the CPU 37 rotates the motor 29 until a toner delivery outlet detecting signal is input from the toner delivery outlet detecting sensor 35. The CPU then stops the drive control of the motor 29 simultaneously with the detection of the toner delivery outlet detecting signal.

Therefore, when the toner supplying operation is completed, the toner delivery outlet 20 of the toner bottle 14 and the toner delivery outlet 26 of the bottle holder 15 always stops in the state of completely facing straight up. The state is maintained by the CPU 37 until the signal which indicates emptiness of toner is detected by the CPU 37 and the next toner supply is started again, or until the toner bottle replacement command is input by operating the touch panel of the operating portion 5. This is the toner delivery outlet positioning control function.

In the state that the toner delivery outlet 26 of the bottle holder 15 faces completely straight up, there is a deviation between the incised groove 23 of the bottle holder 15 and the incised portion 25 of the ring member 24, as illustrated in FIGS. 1 and 2. It is not permitted to pull the toner bottle 14 mounted on the toner bottle 15 out, as the protruding portion 22 of the toner bottle 14 is caught in the annular portion of the ring member 24. Thus, an inadvertent performance of removing the toner bottle 14 in which the toner remains is prevented. The problems such as scattering toner, or the like may be solved at the same time.

On the other hand, in the event of mounting and removing the toner bottle 14 in which toner has been consumed, a panel of the bottle housing portion 13 is opened by manual operation beforehand. The toner bottle replacement command is input in the CPU 37 by operating the touch panel, or the like of the operating portion. Incidentally, it is possible to permit input of the toner bottle replacement command only by a controller mode for preventing an inadvertent operation by users. In that event, it is preferable to allow to input the toner bottle replacement command by input of a personal identification number.

When the CPU 37 receives the toner bottle replacement command, the CPU 37 starts the subprogram to achieve the toner replacement positioning control function. The CPU 37 then controls the motor 29 to be driven by outputting the command to the motor driving circuit 40 for rotating the bottle holder 15 at the angle corresponding to θ in FIG. 6 from the present position (in the state the toner delivery outlet 26 faces straight up). The CPU 37 thereby shifts the position of the incised groove 23 of the bottle holder 15 in FIGS. 1 and 2 to the position corresponding to the incised portion 25 of the ring member 24.

As a result, the positions of the incised groove 23 of the bottle holder 15 and the incised portion 25 of the ring member 24 meet completely to each other. Consequently, operations of removing the consumed toner bottle 14 and mounting a new toner bottle 14 may be permitted.

In the state that the operation of removing the toner bottle 14 is permitted, the toner delivery outlet 20 of the toner bottle 14 is positioned slightly rotated from the position facing straight up. The angle of rotation θ is set at a certain degree beforehand to prevent the toner from spilling, even in the event that the toner remains in the toner bottle 14. Therefore, in a case that the toner bottle 14 is removed having the toner remained therein, a failure such as scattering of toner by mistake is prevented.

Thus, by operating a replacement completion key of the control portion 6 after replacing the toner bottle 14, CPU 37 detects the operation of the key and drives the motor 29 until the toner delivery outlet detecting signal of the toner delivery outlet detecting sensor 35 is detected, that is, until the toner delivery outlet 20 of the toner bottle 14 and the toner delivery outlet 26 of the bottle holder 15 face straight up, then stops the motor 29 at the time of detecting the toner delivery outlet detecting signal.

After that, when the signal which indicates emptiness of toner is newly detected or when the toner bottle replacement command is input, the toner supply control function, the toner delivery outlet positioning control function, or the toner replacement positioning control function of the CPU 37 is started in the same manner as mentioned above and is implemented in the same process as mentioned above repeatedly.

A toner supply device of the present invention is capable of simplifying the structure of a toner bottle which is consumable and reducing running costs having no need to rotate a toner bottle by providing a module in the toner bottle itself, to compose the toner bottle dividing it into a body portion and a cap, or furthermore to make it rotatable between the body portion and the cap, because it is composed to exert feed to toner by rotating the bottle holder which holds the toner bottle.

And as a removal of the toner bottle from the bottle holder is limited in the event that a position of an incised groove formed in the bottle holder meets a position of an incised portion of a ring member, an inadvertent performance of removing the toner bottle is prevented.

And in the state that the performance to remove the toner bottle is permitted, that is, the position of the incised groove meets the position of the incised portion of the ring member, a toner delivery outlet of the toner bottle always faces generally upward and the performance of removing the toner bottle is free from concerns about an inadvertent scattering of toner.

Consequently, it is not necessarily required to provide a lid for preventing toner in the toner bottle from scattering and structure of the toner bottle which is consumable may be simplified all the more.

Besides, it is capable of supplying toner automatically by detecting the shortage of toner in a toner cartridge for development accurately, because it is designed to provide a toner detecting sensor to detect the presence of toner in the toner cartridge for development and to control driving means of the bottle holder based on a signal which indicates emptiness of toner from the toner detecting sensor.

Furthermore, it is also capable of preventing misoperations such as pulling the toner bottle out while toner remains in the toner cartridge for development, because it is designed to provide a toner delivery outlet detecting sensor to detect the state that the toner delivery outlet of the bottle holder is positioned to face upward and to maintain the state that the toner delivery outlet faces upward, that is, the state that pulling the toner bottle out is disabled by the annular portion of the ring member while the signal which indicates the presence of toner is detected from the toner detecting sensor.

And it is also capable of bringing a state wherein the toner bottle is removable by a simple operation with respect to input means, because it is designed to provide input means for commanding replacement of the toner bottle and to rotate the bottle holder to reach the position where the incised portion of the ring member and the incised groove of the bottle holder meet to each other based on the toner bottle replacing command. Besides, even when the toner bottle is in the state of being removable, the toner delivery outlet of the toner bottle is held in the state of facing generally upward and accidents such as scattering the toner inadvertently is prevented, though toner remains in the toner bottle removed.

What is claimed is:

1. A toner supply device comprising; an annular toner bottle provided with a toner delivery outlet on a lateral side portion and an inside helical protrusion for movement of fine particle toward said toner delivery outlet;

a bottle holder which holds the toner bottle removably and rotates integrally with said toner bottle;

a latch mechanism which connects the bottle holder and said toner bottle;

a toner transfer mechanism which feeds toner delivered from said toner bottle to a toner cartridge for development and is disposed on a lower side of said bottle holder;

driving means which drives the bottle holder to rotate or stop, and a control portion which controls the driving means at a predetermined timing, wherein said latch mechanism comprises a protruding portion protruding from a lateral side of said toner bottle and a incised groove which is engaged to said protruding portion and formed in the bottle holder along an inserting direction of said toner bottle, a ring member which holds said toner bottle rotatably and prevents said toner bottle from being removed out of said bottle holder is disposed on the inserting side of the toner bottle of said bottle holder, a incised portion which permits a passage of a protrusion of said toner bottle is provided in a portion of the ring member, and the incised portion is provided in a position slightly rotated from a position of said incised groove specified when said toner delivery outlet face upward.

2. The toner supply device as claimed in claim 1, wherein said ring member is formed annularly.

3. The toner supply device as claimed in claim 1, wherein said toner cartridge for development is provided with a toner detecting sensor which detects the presence of toner in said toner cartridge for development and said control portion is provided with a toner supply control function which operates based on a signal which indicates emptiness of toner from said toner detecting sensor and controls said driving means.

4. The toner supply device as claimed in claim 2, wherein said toner cartridge for development is provided with a toner detecting sensor which detects the presence of toner in said toner cartridge for development and said control portion is provided with a toner supply control function which operates based on a signal which indicates emptiness of toner from said toner detecting sensor and controls said driving means.

5. The toner supply device as claimed in claim 1, wherein said toner cartridge for development is provided with the toner detecting sensor which detects the presence of toner in said toner cartridge for development, a toner delivery outlet detecting sensor which detects the position where said toner delivery outlet of said bottle holder faces upward is provided on the body side of the device opposing to said bottle holder, and said control portion is provided with a toner delivery outlet positioning control function which operates based on the signal which indicates presence of toner from said toner detecting sensor and controls said driving means so that said toner delivery outlet is positioned facing upward.

6. The toner supply device as claimed in claim 5, wherein input means to command the replacement of a toner bottle is provided and said control portion is provided with a toner replacement positioning control function which operates based on a command to replace the toner bottle from said input means and controls said driving means so that said bottle holder rotates to reach the position slightly rotated from the position where said toner delivery outlet faces upward.

7. The toner supply device as claimed in claim 2, wherein said toner cartridge for development is provided with the toner detecting sensor which detects the presence of toner in said toner cartridge for development, a toner delivery outlet detecting sensor which detects the position where said toner delivery outlet of said bottle holder faces upward is provided on the body side of the device opposing to said bottle holder, and said control portion is provided with a toner delivery outlet positioning control function which operates based on the signal which indicates presence of toner from said toner detecting sensor and controls said driving means so that said toner delivery outlet is positioned facing upward.

8. The toner supply device as claimed in claim 7, wherein input means to command the replacement of a toner bottle is provided and said control portion is provided with a toner replacement positioning control function which operates based on a command to replace the toner bottle from said input means and controls said driving means so that said bottle holder rotates to reach the position slightly rotated from the position where said toner delivery outlet faces upward.

* * * * *